US006143430A

United States Patent [19]

Miyasaka et al.

[11] Patent Number: 6,143,430

[45] Date of Patent: Nov. 7, 2000

[54] SURFACE-TREATED STEEL SHEET FOR FUEL CONTAINERS HAVING EXCELLENT CORROSION RESISTANCE, FORMABILITY AND WELDABILITY

[75] Inventors: Akihiro Miyasaka; Shinichi Suzuki, both of Tokai, Japan

[73] Assignee: Nippon Steel Corporation, Tokyo, Japan

[21] Appl. No.: 09/363,715

[22] Filed: Jul. 29, 1999

[30] Foreign Application Priority Data

| | | | |
|---|---|---|---|
| Jul. 30, 1998 | [JP] | Japan | 10-215188 |
| Apr. 27, 1999 | [JP] | Japan | 11-119975 |

[51] Int. Cl.[7] ..... B32B 15/18

[52] U.S. Cl. ..... 428/659; 148/264; 428/632; 428/680; 428/472.1

[58] Field of Search ..... 428/659, 680, 428/632, 472.1; 148/264

[56] References Cited

U.S. PATENT DOCUMENTS

| | | | |
|---|---|---|---|
| 4,663,245 | 5/1987 | Yoshida et al. | 428/659 |
| 5,384,206 | 1/1995 | Ushioda et al. | 428/659 |

FOREIGN PATENT DOCUMENTS

| | | | |
|---|---|---|---|
| 58-45396 | 3/1983 | Japan . | |
| 62-27587 | 2/1987 | Japan . | |
| 63-65087 | 3/1988 | Japan | 428/659 |
| 2-66148 | 3/1990 | Japan | 428/659 |
| 2161499 | 1/1986 | United Kingdom | 428/659 |

*Primary Examiner*—Deborah Jones
*Assistant Examiner*—Robert R. Koehler
*Attorney, Agent, or Firm*—Kenyon & Kenyon

[57] ABSTRACT

Surface treated steel sheet for fuel containers having excellent corrosion resistance, formability and weldability is provided. A steel sheet containing 0.0005–0.0040% of C, 0.005–0.020% of P, 0.0005–0.0040% of N, and 0.0005–0.0030% of B has on at least one surface a first coating layer constituted as a Zn coating layer of a coating weight of 5–80g/m$^2$ and a second coating layer on the first coating layer constituted as a Ni coating layer of a coating weight of 0.5–10g/m$^2$. The Zn coating layer is composed of Zn, Zn—Fe alloy or Zn—Ni alloy. Alternatively, one surface is formed with the first coating layer and the second coating layer and the other surface is formed with a Zn coating layer.

9 Claims, No Drawings

SURFACE-TREATED STEEL SHEET FOR FUEL CONTAINERS HAVING EXCELLENT CORROSION RESISTANCE, FORMABILITY AND WELDABILITY

BACKGROUND OF THE INVENTION

1. Field of the Invention

The present invention relates to a surface treated steel sheet, for fuel containers, having excellent corrosion resistance, formability and weldability and, more particularly to a surface-treated steel sheet which, owing to its excellent formability, weldability and corrosion resistance with respect to automobile fuel and external surface corrosion environments, is suitable as a material for a container for holding and retaining an automobile fuel such as gasoline, alcohol, gasoline containing alcohol, or the like, i.e., a fuel tank, and fuel tank peripheral components.

2. Description of the Related Art

Conventionally, a terne-plated steel sheet comprised of steel sheet coated with a Pb—Sn alloy containing 3–20% of Sn has been used for gasoline tanks. The terne-plated steel sheet has good corrosion resistance against gasoline fuels and also resists corrosion by the water, sulfur and other impurities unavoidably contained in such fuels. It can also withstand the severe press forming needed to form the steel sheet into the shape of the fuel tank, and is good in weldability.

However, terne-plated steel sheet does not have fully adequate corrosion resistance against extremely corrosive fuels such as alcohol fuels, blended fuels of alcohol and gasoline, and fuels containing acids arising from fuel deterioration, formic acid, acetic acid, and/or other organic acids. In recent years, moreover, tightening of environmental regulations and, in particular, restrictions on Pb dissolution from scrapped vehicles, has created a demand for Pb-free steel sheet.

In response to the need for steel sheet with excellent corrosion resistance with respect to alcohol fuels, blended fuels of alcohol and gasoline, and other fuels with extremely severe corrosivity, JP-A-(unexamined published Japanese patent application)58-45396 discloses a steel sheet whose surface is coated with a Ni alloy containing 5–50% of Zn to a thickness of 0.5–20$\mu$m. JP-A-60-121295, on the other hand, discloses a steel sheet for fuel containers obtained by electroplating the surface of a sheet with a Zn—Ni alloy containing 5–30% of Ni and further forming a Sn-coating layer thereon.

However, the corrosion resistance of the coating layers obtained by these technologies is degraded by the presence of pinholes. Moreover, during press forming, pinholes and other defects that form in the coating develop into cracks that degrade the corrosion resistance of the coating layer. Total elimination of such coating defects is difficult both technically and economically.

JP-A-62-27587 discloses a steel sheet characterized in that a first coating layer composed of Zn or Zn—Ni alloy is formed on the steel sheet surface and a Ni surface layer is formed on the first coating layer. This steel sheet is excellent in corrosion resistance against alcohol fuels and blended fuels of alcohol and gasoline.

When a steel sheet coated with a low-melting point metal such as Zn is resistance-welded using a copper electrode to pass current, it may incur cracks at the welded metal surface under conditions of high welding current. This is thought to be attributable to liquid metal embrittlement caused by a low-melting point metal such as copper or zinc. Prevention of cracking is necessary in order to improve productivity by expanding the range of production conditions and also in order to enhance the reliability of the component. JP-A-62-27587 is completely silent regarding such cracking and discloses nothing regarding prevention. Moreover, it was found that adding 5% or less of Co to the surface coating metal had absolutely no effect on susceptibility to cracking.

SUMMARY OF THE INVENTION

In view of the foregoing circumstances, an object of the present invention is to provide a surface treated steel sheet for fuel containers having excellent corrosion resistance, formability and weldability, that is excellent in corrosion resistance with respect to the corrosive environments at the internal and external surfaces of a fuel tank, that can withstand severe press forming, and that exhibits excellent weldability with good resistance to surface layer cracking during resistance welding.

The inventor conducted various studies regarding means for achieving excellent corrosion resistance against alcohol fuels and blended fuels of alcohol and gasoline while also imparting the formability needed to withstand severe press forming. These studies led to the discovery that not only corrosion resistance and formability but also welded metal cracking resistance can be markedly improved by precisely controlling the C, P, N and B contents of the steel composition of a steel sheet having on its surface a Zn or Zn-system alloy coating layer and on this coating layer a Ni coating layer.

Specifically, a first aspect of present invention provides a surface treated steel sheet for fuel containers having excellent corrosion resistance, formability and weldability comprising a base metal of a steel sheet containing, in wt %, 0.0005–0.0040% of C, 0.0005–0.0040% of N, 0.005–0.020% of P and 0.0005–0.0030% of B, a first coating layer formed on at least one surface of the steel sheet as a Zn coating layer of a coating weight of 5–80g/m$^2$, and a second coating layer formed on the first coating layer as a Ni coating layer of a coating weight of 0.5–10g/m$^2$.

A second aspect of present invention provides a surface treated steel sheet for fuel containers having excellent corrosion resistance, formability and weldability according to the first aspect, wherein the Zn coating layer as the first coating layer is a Zn—Fe-alloy coating layer containing not more than 25wt % of Fe and having a coating weight of 5–80g/m$^2$.

A third aspect of the present invention provides a surface treated steel sheet for fuel containers having excellent corrosion resistance, formability and weldability according to the first aspect, wherein the Zn coating layer as the first coating layer is a Zn—Ni-alloy coating layer containing not more than 25wt % of Ni and having a coating weight of 5–80g/m$^2$.

A fourth aspect of the present invention provides a surface treated steel sheet for fuel containers having excellent corrosion resistance, formability and weldability according to any of the first to third aspects, wherein the first coating layer and the second coating layer are present on both surfaces of the steel sheet.

A fifth aspect of the present invention provides a surface treated steel sheet for fuel containers having excellent corrosion resistance, formability and weldability according to any of the first to third aspects, wherein the first coating layer and the second coating layer are present on only one surface of the steel sheet.

A sixth aspect of the present invention provides a surface treated steel sheet for fuel containers having excellent corrosion resistance, formability and weldability according to the first aspect, wherein the surface of the steel sheet not having the first coating layer and the second coating layer has a Zn coating layer of a coating weight of 5–80g/m$^2$.

A seventh aspect of present invention provides a surface treated steel sheet for fuel containers having excellent corrosion resistance, formability and weldability according to the sixth aspect, wherein the Zn coating layer of the surface of the steel sheet not having the first coating layer and the second coating layer is a Zn—Fe-alloy coating layer containing not more than 25wt % of Fe and having a coating weight of 5–80g/m$^2$.

An eighth aspect of present invention provides a surface treated steel sheet for fuel containers having excellent corrosion resistance, formability and weldability according to the sixth aspect, wherein the Zn coating layer of the surface of the steel sheet not having the first coating layer and the second coating layer is a Zn—Ni-alloy coating layer containing not more than 25wt % of Ni and having a coating weight of 5–80g/m$^2$.

A ninth aspect of the present invention provides a surface treated steel sheet for fuel containers having excellent corrosion resistance, formability and weldability according to any of the first to eighth aspects, further comprising a chromate film of a coating weight of 1–70mg/m$^2$ as metallic Cr on at least the Ni coating layer.

DESCRIPTION OF THE PREFERRED EMBODIMENTS

The invention will now be explained in detail. Unless otherwise noted, all percentages, with respect to present invention, are by weight.

In the present invention, the contents of C, P, N and B contained in the steel sheet as alloying elements are precisely controlled. The reason for this is as follows.

C: When the carbon content is less than 0.0005%, the contents of P, N and B necessary for preventing or reducing cracking of the welded metal surface layer become excessive to the point of degrading the formability of the steel sheet. When the C content is greater than 0.0040%, good formability of the steel sheet cannot be secured irrespective of P, N and B content. In consideration of steel sheet formability and surface layer cracking reduction, a more preferable C content is 0.0010–0.0025%.

P: When the phosphorous content is less than 0.005%, the contents of C, N and B necessary for preventing or reducing cracking of the welded metal surface layer become excessive to the point of degrading the formability of the steel sheet. When the P content is greater than 0.020%, the risk of the steel sheet experiencing secondary working brittleness increases. Excessive P content is therefore undesirable. In consideration of steel sheet formability and surface layer cracking reduction, a more preferable P content is 0.007–0.016%.

N: When the nitrogen content is less than 0.0005%, the contents of C, P and B necessary for preventing or reducing cracking of the welded metal surface layer become excessive to the point of degrading the formability of the steel sheet. When the N content is greater than 0.0040%, the aging property of the steel sheet becomes a problem. In consideration of steel sheet formability, aging property and surface layer cracking reduction, a more preferable N content is 0.0010–0.0035%.

B: When the boron content is less than 0.0005%, the contents of C, P and N necessary for preventing or reducing cracking of the welded metal surface layer become excessive to the point of degrading the formability of the steel sheet. When the B content is greater than 0.0030%, the formability of the steel sheet is markedly degraded irrespective of C, P and N content. In consideration of steel sheet formability and surface layer cracking reduction, a more preferable B content is 0.0010–0.0025%.

Addition of elements other than C, P, N and B to the steel is not particularly restricted and the steel constituents can be appropriately selected to ensure the strength, formability and other properties required of a surface treated steel sheet for fuel containers. Elements that can be added with particular effect to a steel whose C, P, N and B contents fall within the ranges specified by the present invention include Al for the purpose of deoxidation, Ti and/or Nb for the purpose of improving formability, and reducing the Si contents for the purpose of improving the hot-dip zinc coating property. Such additions also fall within the purview of present invention.

The effect of the invention is thoroughly manifested when applied to either a cold-rolled steel sheet or a hot-rolled steel sheet manufactured by an ordinary process and the effect of the invention is not greatly changed by the production history of the steel sheet. Moreover, the steel sheet may be one whose surface has been appropriately formed with a flash-coating layer (such as for further enhancing coating adhesion) prior to formation of the first coating layer. This layer may contain one or more of Ni, Fe, Co and Cu individually or as alloy. Insofar as the layer contains at least one of these four elements, it may contain an alloy with a non-metal. The coating weight of the plating layer is preferably in the range of, for example, 0.001–10g/m$^2$. It is also within the purview of the present invention for the surface treated steel sheet for fuel containers to have a flash-coating layer into which, at time of forming the first coating layer, constituent elements of the steel sheet matrix or constituent elements of the first coating layer invade and disperse. The presence of a flash-coating layer can be ascertain by, for example, subjecting the region of the interface between the matrix of the surface-treated steel sheet and the first coating layer (Zn coating layer) to elemental analysis by EMPA.

The reasons for the limitations on the coating will now be explained.

The Zn coating constituting the first coating layer is a Zn coating or a Zn-alloy coating having a coating weight of 5–80g/m$^2$. At a coating weight of less than 5g/m$^2$ the anticorrosion effect at the interior and exterior surfaces of the fuel tank is insufficient. At a coating weight greater than 80g/m$^2$, the press formability decreases. The coating weight is more preferably 10–60g/m$^2$. In the present invention, the Zn coating can be formed of Zn only or of a Zn alloy containing not less than 75% of Zn. When the Zn content is less than 75%, the anticorrosion performance decreases. Among the various Zn-alloy coatings for constituting the first coating layer, one composed of Zn—Fe alloy containing not more than 25% of Fe and one composed of Zn—Ni alloy containing not more than 25% of Ni are particularly effective for achieving both a marked improvement in press formability and an improvement in corrosion resistance of the painted exterior surface of the fuel tank.

When the Fe content of the Zn—Fe-alloy coating is greater than 25% , the coating adhesion decreases and there is observed a tendency for the formability to deteriorate rather than improve. The Fe content is more preferably 5–14%.

When the Ni content of the Zn—Ni-alloy coating is greater than 25%, there is observed a tendency for the anticorrosion effect and the formability to fall rather than rise. The upper limit is therefore set at 25%. The Ni content is more preferably 7–14%.

In order to enhance corrosion resistance, coating adhesion, formability and other properties, the Zn coating layer of the present invention can be incorporated with one or more of Al, Pb, Sb, C, Si, P, Fe, Sn, Mg, Mn, Ni, Cr, Co, Cu, Ca, Li, Ti, B and rare earth elements. The Zn—Fe-alloy coating and the Zn—Ni-alloy coating of course contain Fe and Ni. No problem is caused if any of these elements should find its way into the Zn coating as an impurity.

When the coating weight of the Ni coating layer formed on the first coating layer as the second coating layer is less than 0.5g/m$^2$, the press formability and the corrosion resistance at the interior surface of the fuel tank are insufficient. The corrosion resistance improving effect of the Ni coating layer saturates and may even exhibit a tendency to decrease when the coating weight exceeds 10g/m$^2$. The coating weight of the Ni coating layer constituting the second coating layer is more preferably 1–7g/m$^2$.

In present invention, no problem is caused by the Ni coating layer constituting the second coating layer containing or being invaded by one or more of Al, Pb, Sb, C, Si, P, Fe, Sn, Mg, Mn, Cr, Co, Cu, Ca, Li, Ti, Zn, B and rare earth elements.

The first coating layer and the second coating layer must be imparted to the surface on at least one side of the steel sheet. That is, they can be imparted either to both surfaces or to only one surface of the steel sheet. In cases where both surfaces of the steel sheet are destined to be contacted by fuel, as when the steel sheet is used to fabricate a component attached to the fuel tank interior, both surfaces of the steel sheet must have the first coating layer and the second coating layer. In cases where only one surface of the steel sheet is destined to be contacted by fuel, as when the steel sheet is used to fabricate the fuel tank per se, it suffices for at least one surface of the steel sheet to have the first coating layer and the second coating layer. That is to say, the surface destined to constitute the outer surface of the fuel tank need not necessarily have the first coating layer and the second coating layer. However, it can, of course, be provided with the first coating layer and the second coating layer and this is advantageous from the aspect of steel sheet production because it is easier to impart the same coating to both sides. In this case, the type of coating, coating composition and coating weight can be the same on both sides. Alternatively, when the surfaces require different properties or cost is a concern, the type of coating, coating composition and coating weight can be differentiated between the two sides without departing from the scope of the present invention.

When the first coating layer and the second coating layer are imparted to only one surface for cost reduction, the other side surface is preferably formed with a Zn coating layer so as to have corrosion resistance. The coating weight of this Zn coating layer is preferably 5–80g/m$^2$. A coating weight of less than 5g/m$^2$ does not provide adequate anticorrosion effect, while the effect of the Zn coating layer saturates at a coating weight of greater than 80g/m$^2$. The upper limit is therefore set at 80g/m$^2$ from the viewpoint of economy. The coating weight is more preferably 10–60g/m$^2$. In the present invention, the Zn coating on the other surface can be formed of Zn only or of a Zn alloy containing not less than 75% of Zn. When the Zn content is less than 75%, the anticorrosion performance decreases. Among the various usable Zn-alloy coatings, one composed of Zn—Fe alloy containing not more than 25% of Fe and one composed of Zn—Ni alloy containing not more than 25% of Ni are particularly effective for achieving both a marked improvement in press formability and an improvement in corrosion resistance of the painted exterior surface of the fuel tank.

When the Fe content of the Zn—Fe-alloy coating is greater than 25%, the coating adhesion decreases and there is observed a tendency for the formability to deteriorate rather than improve. The Fe content is more preferably 5–14%.

When the Ni content of the Zn—Ni-alloy coating is greater than 25%, there is observed a tendency for the anticorrosion effect and the formability to fall rather than rise. The upper limit is therefore set at 25%. The Ni content is more preferably 7–14%.

In order to enhance corrosion resistance, coating adhesion, formability and other properties, the Zn coating layer on the other side can be incorporated with one or more of Al, Pb, Sb, C, Si, P, Fe, Sn, Mg, Mn, Ni, Cr, Co, Cu, Ca, Li, Ti, B and rare earth elements. The Zn—Fe-alloy coating and the Zn—Ni-alloy coating of course contain Fe and Ni. No problem is caused if any of these elements should find its way into the Zn coating as an impurity.

When the first coating layer and the second coating layer are formed on only one surface, the coating composition and coating weight on the other surface can be the same as those of the first coating layer. Alternatively, when the surfaces require different properties or cost is a concern, the coating composition and coating weight can be differentiated from those of the first coating layer.

The present invention does not particularly define the coating method. Any of various commonly used coating methods can be used. For instance, methods usable for the first coating layer include electroplating, hot-dip coating, alloying hot galvanizing and vapor-deposition coating. Methods usable for the second coating layer include electroplating and vapor-deposition coating. When the first coating layer and the second coating layer are present only on one surface, the coating on the other surface can be formed by a method such as electroplating hot-dip coating, alloying hot galvanizing or vapor-deposition coating. In such cases, production can be simplified and cost reduced by first imparting the first coating layer to both surfaces of the steel sheet and thereafter imparting the second coating layer to only one surface.

Subjecting the coating layer to conventional chromating treatment further improves the corrosion resistance and the paint adhesion property of the invention steel sheet. When the steel sheet is subjected to chromating, an especially good effect is obtained by forming the chromate film on at least the Ni coating layer. Chromating can of course be applied to both surfaces even if the first coating layer and the second coating layer are formed on only one surface. The desired effect of the chromating is not obtained at a coating weight as metallic Cr of less than 1mg/m$^2$, while the effect saturates at a coating weight greater than 70mg/m$^2$. The coating weight is more preferably 5–60mg/m$^2$.

Various other surface treatments not mentioned in the foregoing can course also be imparted to the invention steel sheet. These include, for example, lubricity enhancement, resin coating, weldability enhancement, phosphating and treatment for enhancing phosphating property. Any of such treatments can be additionally conducted to secure required properties without departing from the scope of the present invention.

The strength of the invention steel sheet falls within a broad range extending from, for example, the less than 300

$N/mm^2$ tensile strength of an ordinary steel or ultra-deep drawing steel sheet to the 300 $N/mm^2$ or higher strength of a high-strength steel (300, 340, 400 and 440 $N/mm^2$ class steels).

EXAMPLE 1

Cold-rolled steel sheets produced in conformance with JIS G3141 SPCE to have the C, P, N and B contents shown in Table 1 were imparted with the coatings shown in Table 1. The steel compositions also included 0.01–0.02% of Si, 0.15–0.20% of Mn, 0.006–0.008% of S, 0.025–0.31% of Al, 0.025–0.033% of Ti, and 0.007–0.009% of Nb. After degreasing, each sheet was first coating with Zn or Zn alloy by the method shown in Table 1 and was then coated thereon with Ni by ordinary electroplating. The sheet thickness was 0.8mm. In Table 1, Nos. 1–13 are invention examples and Nos. 14–21 are comparative examples. Nos. 2, 3 and 5–13 were imparted with chromate films by an ordinary coating-type chromating method. The surface of each steel sheet destined to become the interior surface of the fuel tank, i.e., the surface to be in contact with fuel, was defined as the Top Surface.

The Ni coating was conducted using the following bath composition and coating conditions:

| | | |
|---|---|---|
| $NiSO_4.6H_2O$ | 300 | g/l |
| $H_3BO_3$ | 30 | g/l |
| Bath temp. | 50 | ° C. |
| Current density | 50 | $A/dm^2$ |

A test specimen was taken from each steel sheet and evaluated for formability, corrosion resistance after forming, and weldability. Formability was evaluated by the limiting drawing ratio [(largest blank diameter drawable without cracking)/(punch diameter)] in a cylindrical deep-drawing test. A larger limiting drawing ratio indicates better formability.

The corrosion resistance after forming was tested in the following manner. First, a round test piece was formed into a cylindrical shape of 50mm inner diameter and 35mm depth at a drawing ration of 2.0 with the Top Surface shown in Table 1 as the inner surface, the concave portion was filled with corrosion test liquid and sealed, and the sealed test piece was allowed to stand for two months at 30° C. Two types of corrosion test liquids of the compositions shown below were used. As comparative examples Nos. 15, 17 and 19 could not be formed at a drawing ratio of 2.0, they were formed at a drawing ration of 1.8.

| | | |
|---|---|---|
| Corrosion test liquid 1 | | |
| Gasoline | Balance | |
| Water | 1.0 | vol % |
| Formic acid | 0.1 | g/l |
| Corrosion test liquid 2 | | |
| Gasoline | Balance | |
| Ethanol | 30 | vol % |
| Formic acid | 0.1 | g/l |
| Water | 1.0 | vol % |
| NaCl | 0.05 | g/l |

The corrosion resistance after forming was evaluated by observing the corrosion test liquid and the concave portion after completion of the corrosion test. The observed states were rated as follows:

◎: Absolutely no abnormality or extremely slight corrosion
○: Slight corrosion
Δ: Partial corrosion
x: Corrosion throughout or local corrosion
xx: Intense corrosion throughout or intense local corrosion Weldability was evaluated by stacking two steel sheets of the example to be evaluated, lap seam welding the sheets using copper ring electrodes as the welding electrodes, and checking the welded metal surface layer for presence of cracks. The welding current was 20kA and welding speed was 3m/min. The weld metal was examined for defects by x-ray transmission testing. The results were rated as follows:

◎: No cracks
x: Cracks

The results of the evaluations are shown in Table 1. As is clear from Table 1, the invention examples (Nos. 1–13) were extremely good in formability and corrosion resistance, did not experience cracking at the welds, and were far superior in corrosion resistance to the Pb-10Sn%-alloy coated steel sheet of example No. 21. In contrast, the comparative examples (Nos. 14–20) were inferior in corrosion resistance, exhibited insufficient formability of the steel shaft, or were inferior in weldability.

As demonstrated in the foregoing, the present invention provides a surface treated steel sheet for fuel containers that is excellent in all of formability, corrosion resistance, and weldability.

TABLE 1

| | Steel sheet composition | | | | Top Surface | | | | Bottom surface | | | | | | | | |
|---|---|---|---|---|---|---|---|---|---|---|---|---|---|---|---|---|---|
| | | | | | First coating layer | | Second coating layer | | Lower coating layer | | Upper coating layer | | | | | | |
| | C | P | N | B | Composition | Coating Wt. ($g/m^2$) | Composition | Coating Wt. ($g/m^2$) | Composition | Coating Wt. ($g/m^2$) | Composition | Coating Wt. ($g/m^2$) | 1st coating layer method | Chromate film metallic Cr content | Machinability | Post-machining corrosion resistance Liquid 1 | Post-machining corrosion resistance Liquid 2 | Weldability |
| 1 | 0.0012 | 0.008 | 0.0022 | 0.0018 | Zn | 42 | Ni | 3.0 | Zn | 40 | Ni | 3.2 | Hot-dip | — | 2.30 | ◎ | ◎ | ◎ |
| 2 | 0.0015 | 0.012 | 0.0024 | 0.0018 | Zn | 55 | Ni | 2.6 | Zn | 49 | Ni | 2.4 | Hot-dip | 24 | 2.25 | ◎ | ◎ | ◎ |
| 3 | 0.0022 | 0.009 | 0.0019 | 0.0015 | Zn | 38 | Ni | 1.8 | Zn | 38 | Ni | 3.3 | Hot-dip | 18 | 2.25 | ○ | ○ | ◎ |
| 4 | 0.0008 | 0.015 | 0.0026 | 0.0012 | Zn | 40 | Ni | 5.3 | Zn | 39 | Ni | 4.9 | Electro Plate | — | 2.25 | ◎ | ◎ | ◎ |
| 5 | 0.0013 | 0.013 | 0.0020 | 0.0020 | Zn-20% Fe | 38 | Ni | 3.9 | Zn-20% Fe | 39 | Ni | 3.7 | Electro Plate | 22 | 2.30 | ◎ | ◎ | ◎ |
| 6 | 0.0019 | 0.008 | 0.0016 | 0.0013 | Zn-19% Fe | 42 | Ni | 3.1 | Zn-19% Fe | 41 | Ni | 3.0 | Electro Plate | 20 | 2.25 | ◎ | ◎ | ◎ |
| 7 | 0.0000 | 0.011 | 0.0018 | 0.0024 | Zn-13% Ni | 48 | Ni | 2.9 | Zn-13% Ni | 45 | Ni | 2.9 | Electro Plate | 17 | 2.25 | ○ | ○ | ◎ |
| 8 | 0.0014 | 0.010 | 0.0020 | 0.0015 | Zn-10% Fe | 51 | Ni | 2.5 | Zn-10% Fe | 39 | Ni | 3.4 | Alloying hot galvanizing | 9 | 2.30 | ◎ | ○ | ◎ |
| 9 | 0.0017 | 0.009 | 0.0022 | 0.0013 | Zn | 59 | Ni | 3.4 | Zn | 40 | Ni | 3.5 | Hot-dip | 20 | 2.30 | ◎ | ◎ | ◎ |
| 10 | 0.0012 | 0.014 | 0.0021 | 0.0017 | Zn | 47 | Ni | 2.8 | Zn | 43 | None | — | Hot-dip | 19 | 2.25 | ◎ | ◎ | ◎ |
| 11 | 0.0023 | 0.007 | 0.0022 | 0.0011 | Zn-12% Ni | 38 | Ni | 6.8 | Zn-12% Ni | 36 | Ni | 5.2 | Electro Plate | 8 | 2.25 | ◎ | ◎ | ◎ |
| 12 | 0.0013 | 0.010 | 0.0020 | 0.0012 | Zn-9.3% Fe | 28 | Ni | 9.3 | Zn-9.3% Fe | 37 | Ni | 4.3 | Electro Plate | 19 | 2.20 | ◎ | ◎ | ◎ |
| 13 | 0.0016 | 0.012 | 0.0023 | 0.0015 | Zn | 49 | Ni | 9.5 | Zn | 46 | Ni | 3.0 | Hot-dip | 10 | 2.25 | ◎ | ◎ | ◎ |
| 14 | 0.0011 | 0.007 | 0.0017 | 0.0002 | Zn | 56 | Ni | 5.4 | Zn | 50 | Ni— | 6.3 | Hot-dip | — | 2.25 | ◎ | ◎ | x |
| 15 | 0.0045 | 0.009 | 0.0014 | Zn | 52 | Ni | 4.2 | Zn | 53 | Ni | 3.8 | Hot-dip | — | 1.90 | ◎ | ◎ | ◎ | |
| 16 | 0.0009 | 0.001 | 0.0017 | 0.0004 | Zn-11% Fe | 51 | Ni | 3.3 | Zn-11% Fe | 55 | None | — | Alloying hot galvanizing | — | 2.25 | ◎ | ◎ | x |
| 17 | 0.0018 | 0.012 | 0.0047 | 0.0017 | Zn | 48 | Ni | 6.2 | Zn | 47 | Ni | 5.9 | Hot-dip | — | 1.85 | ◎ | ◎ | x |
| 18 | 0.0020 | 0.011 | 0.0027 | 0.0016 | Zn | 57 | Ni | 0.1 | Zn | 55 | Ni | 0.1 | Hot-dip | — | 2.20 | x | xx | ◎ |
| 19 | 0.0025 | 0.012 | 0.0024 | 0.0030 | Zn-12% Ni | 46 | Ni | 3.7 | Zn-12% Ni | 40 | Ni | 3.7 | Electro | — | 1.80 | ◎ | ◎ | ◎ |
| 20 | 0.0020 | 0.009 | 0.0021 | 0.0003 | Zn-12% Fe | 48 | Ni | 5.2 | An-12% Fe | 48 | Ni | 5.4 | Electro | — | 2.20 | % | % | x |
| 21 | 0.0018 | 0.011 | 0.0023 | 0.0002 | Pb-10% Sn | 60 | None | — | Pb-10% Sb | 60 | None | — | Hot-dip | — | 2.25 | x | x | x |

We claim:

1. A surface treated steel sheet for fuel containers having excellent corrosion resistance, formability and weldability comprising a base metal of a steel sheet containing, in wt %, 0.0005–0.0040% of C, 0.0005–0.0040% of N, 0.005–0.020% of P and 0.0005–0.0030% of B, a first coating layer formed on at least one surface of the steel sheet as a Zn coating layer of a coating weight of 5–80g/$m^2$, and a second coating layer formed on the first coating layer as a Ni coating layer of a coating weight of 0.5–10g/$m^2$.

2. A surface treated steel sheet for fuel containers having excellent corrosion resistance, formability and weldability as claimed in claim 1, wherein the Zn coating layer as the first coating layer is a Zn—Fe-alloy coating layer containing not more than 25wt % of Fe and having a coating weight of 5–80g/$m^2$.

3. A surface treated steel sheet for fuel containers having excellent corrosion resistance, formability and weldability as claimed in claim 1, wherein the Zn coating layer as the first coating layer is a Zn—Ni-alloy coating layer containing not more than 25wt % of Ni and having a coating weight of 5–80g/$m^2$.

4. A surface treated steel sheet for fuel containers having excellent corrosion resistance, formability and weldability as claimed in claim 1, wherein the first coating layer and the second coating layer are present on both surfaces of the steel sheet.

5. A surface treated steel sheet for fuel containers having excellent corrosion resistance, formability and weldability as claimed claim 1, wherein the first coating layer and the second coating layer are present on only one surface of the steel sheet.

6. A surface treated steel sheet for fuel containers having excellent corrosion resistance, formability and weldability as claimed in claim 5, wherein the surface of the steel sheet not having the first coating layer and the second coating layer has a Zn coating layer of a coating weight of 5–80g/$m^2$.

7. A surface treated steel sheet for fuel containers having excellent corrosion resistance, formability and weldability as claimed in claim 6, wherein the Zn coating layer of the surface of the steel sheet not having the first coating layer and the second coating layer is a Zn—Fe-alloy coating layer containing not more than 25wt % of Fe and having a coating weight of 5–80g/$m^2$.

8. A surface treated steel sheet for fuel containers having excellent corrosion resistance, formability and weldability as claimed in claim 6, wherein the Zn coating layer of the surface of the steel sheet not having the first coating layer and the second coating layer is a Zn—Ni-alloy coating layer containing not more than 25wt % of Ni and having a coating weight of 5–80g/$m^2$.

9. A surface treated steel sheet for fuel containers having excellent corrosion resistance, formability and weldability as claimed in claim 1, further comprising a chromate film of a coating layer of 1–70mg/$m^2$ as metallic Cr on at least the Ni coating layer.

* * * * *